US010045622B1

(12) United States Patent
Stoner

(10) Patent No.: US 10,045,622 B1
(45) Date of Patent: Aug. 14, 2018

(54) TELESCOPING OBSERVATION CHAIR ASSEMBLY INCLUDING SEAT AND FOOTREST

(71) Applicant: Robert A. Stoner, Brighton, IL (US)

(72) Inventor: Robert A. Stoner, Brighton, IL (US)

( * ) Notice: Subject to any disclaimer, the term of this patent is extended or adjusted under 35 U.S.C. 154(b) by 0 days.

(21) Appl. No.: 15/430,068

(22) Filed: Feb. 10, 2017

(51) Int. Cl.

| | |
|---|---|
| ***A47C 3/00*** | (2006.01) |
| ***A47C 3/40*** | (2006.01) |
| ***A47C 7/50*** | (2006.01) |
| ***A47C 9/00*** | (2006.01) |
| ***A47C 12/00*** | (2006.01) |

(52) U.S. Cl.
CPC ..... *A47C 3/40* (2013.01); *A47C 7/506* (2013.01); *A47C 9/00* (2013.01); *A47C 12/00* (2013.01)

(58) Field of Classification Search
CPC .. A47C 9/002; A47C 3/18; A47C 3/00; A47C 16/025; A47C 13/00; A47C 3/16; A47C 7/506; A61G 5/1059; B60N 3/063; B60N 2/995; B64D 11/0643
USPC .... 297/311, 423.39, 423.41, 423.44, 423.45, 297/175, 178, 423.14
See application file for complete search history.

(56) References Cited

U.S. PATENT DOCUMENTS

| | | | | |
|---|---|---|---|---|
| 2,229,769 | A * | 1/1941 | Raders | B61C 17/04 248/405 |
| 4,427,234 | A * | 1/1984 | Peters | A47C 16/025 297/423.45 |
| 6,158,552 | A * | 12/2000 | Gould | A47C 12/02 182/200 |
| 7,052,082 | B1 * | 5/2006 | Thomas | A47C 1/04 297/148 |
| 8,216,114 | B1 * | 7/2012 | Wynn, III | A63B 23/0458 297/338 |
| 2010/0026075 | A1 * | 2/2010 | Zenisek | A47C 7/50 297/411.2 |

* cited by examiner

*Primary Examiner* — Shin H Kim
(74) *Attorney, Agent, or Firm* — Quarles & Brady LLP

(57) ABSTRACT

Provided are systems and methods for a telescope observation chair assembly. The assembly includes a seat having a pad, a telescoping portion extending from the pad, and an adjustment assembly at least partially disposed interior to the telescoping portion. The assembly also includes a housing comprising one or more walls having one or more slots and one or more grooves cutout therefrom, the one or more walls receiving the telescoping portion of the seat. The assembly further includes a footrest.

20 Claims, 10 Drawing Sheets

20

22
28
50
90
30
62
32
84
C
66
60
76
92
98
96
100
72
74
80
102
70

TELESCOPING OBSERVATION CHAIR ASSEMBLY INCLUDING SEAT AND FOOTREST

FIELD OF THE INVENTION

The present invention relates to a telescoping observation chair that is designed to provide a comfortable, adjustable seat height with a built-in, adjustable footrest for individuals using a telescope. The chair allows the telescope to be viewed from a stable and comfortable position.

BACKGROUND

When using a telescope, for example a Dobsonian telescope, a chair with an adjustable height can be utilized to make a night of observing more comfortable and enjoyable. When using a Dobsonian telescope, many telescope observers who do not employ an adjustable chair are required to use a ladder or some other upright structure that allows for use of the telescope at increased heights. Existing telescope observation chairs are made of a wide variety of materials, ranging from wood to metal to synthetic material (e.g., plastic), and may include a seat that is padded or upholstered in various colors and fabrics.

Some existing telescope observation chair assemblies include one or more lengths of wood or plastic, which may be referred to as rails or stringers, that are pivotable about a pivot point (in a similar fashion as a stepladder) and include a plurality of crossbars or rungs along a single rail or between multiple rails. Existing chairs also may include a footrest that can be moved from rung to rung in a similar fashion as the seat. These existing telescope observation chairs have some benefits, such as being foldable and moveable from one location to another by folding the rails together.

Existing telescope observation chair assemblies are also generally lightweight, as such assemblies typically include two or more rails, a plurality of rungs, which may comprise rods disposed between multiple rails or may comprise cutouts from within a single rail, a seat, and a footrest. However, existing telescope observation chairs also have a number of drawbacks. For example, because of the nature of the stepladder-like configuration of such assemblies, the footprint taken up during use of currently available chairs is quite large. Still further, such chairs are limited in available adjustable height by the footprint required on the ground when the observation chair is in an "in-use" configuration, and by the fact that such assemblies can be top heavy.

The designs of existing telescope observation chair assemblies have likely been limited to a stepladder-like configuration because of the ease with which such assemblies can be stored and transported. However, such designs lend themselves to limited height adjustability because as increased heights are desired, a larger footprint for the bases of the rails is required. Another drawback is that, as the seat of such assemblies is adjusted higher, the height of the center of gravity increases, which limits the ultimate achievable height of the seat. These limitations have limited the variety and use of existing adjustable seats.

Therefore, it is desirable to provide a telescope observation chair assembly including an adjustable seat and a footrest that takes up a small footprint while allowing for increased adjustability of both the seat and the footrest while maintaining a center of gravity that prevents the device from tipping or falling over.

SUMMARY

The present invention provides systems and methods for a telescope observation chair assembly that includes an adjustable seat and footrest.

In some embodiments, the assembly includes a seat including: a pad, a telescoping portion extending from the pad, and an adjustment assembly at least partially disposed interior to the telescoping portion. The assembly further includes a housing comprising one or more walls having one or more slots and one or more grooves cutout therefrom, the one or more walls receiving the telescoping portion of the seat, one or more support planks, the one or more support planks having a plurality of notches, and one or more feet extending from a base portion of the housing. The assembly further includes a footrest comprising an arm, a first leg connected with the arm, a second leg connected with the arm, a first stabilizing rod, and one or more stabilizing pins. The first stabilizing rod connects the first leg to the second leg, and the one or more stabilizing pins are connected to one or more of the first leg and the second leg. The one or more stabilizing pins are received by the one or more notches of the one or more support planks.

In some embodiments, the one or more support planks includes a first support plank and a second support plank. In some embodiments, the plurality of notches are semicircular cutouts. In some embodiments, the first support plank and the second support plank are parallel with a longitudinal axis of the seat. In some embodiments, the one or more walls comprises a first wall, a second wall, a third wall, and a fourth wall.

In some embodiments, the one or more notches and the one or more slots are cut out of the first wall and the third wall. In some embodiments, the one or more walls define a rectangular cross section. In some embodiments, the adjustment assembly includes an upper adjustment assembly and a lower adjustment assembly. The upper adjustment assembly comprising a handle, an adjustment rod coupled with the handle, and a cable coupled with the adjustment rod, and the lower adjustment assembly comprising a locking bar, a locking rod disposed adjacent the locking bar; a first slide coupled with the locking bar, and a second slide coupled with the locking bar.

In some embodiments, the lower adjustment assembly further includes a first stationary plank, a second stationary plank, a third stationary plank, and a fourth stationary planks. Each of the stationary planks is coupled with an interior side of the one or more walls of the housing. In some embodiments, the assembly further includes a first spring coupled with the first stationary plank and the third stationary plank, and a second spring coupled with the second stationary plank and the fourth stationary plank.

In some embodiments, each of the first spring and the second spring maintain the locking rod in place within one of the plurality of notches during an "in use" configuration of the assembly. In some embodiments, the housing comprises wood. In some embodiments, the plurality of grooves includes at least 9 grooves, and the plurality of notches includes at least 5 notches. In some embodiments, the housing further includes a ledge that is adjacent the one or more walls. In some embodiments, the footrest is capable of being rotated into a non-use configuration and an in-use configuration.

In some embodiments, a method of operating a telescope observation chair assembly includes the steps of rotating a handle from a first position to a second position to release a locking rod from a first notch of a plurality of notches, the locking rod disposed within a telescoping portion of a seat, translating the seat vertically, rotating the rod to the first position to engage the locking rod with a second notch of the plurality of notches, and rotating a footrest from a first configuration to a second configuration, the footrest having an arm, a first leg connected with the arm, a second leg connected with the arm, a first stabilizing rod, and one or more stabilizing pins. The first stabilizing rod connects the first leg to the second leg, and the one or more stabilizing pins are connected to one or more of the first leg and the second leg. The one or more stabilizing pins are received by the one or more notches of one or more support planks coupled with a housing of the chair assembly.

In some embodiments, the housing includes a first wall, a second wall, a third wall, and a fourth wall, the walls telescopically receiving the telescoping portion of the seat. In some embodiments, the seat includes a first leg, a second leg, a third leg, and a fourth leg. In some embodiments, rotating the handle from the first position to the second position raises a cable that is coupled with a locking rod, the locking rod moving from within the first notch to a longitudinal slot. In some embodiments, the seat includes an upholstered pat at an upper end thereof.

DETAILED DESCRIPTION

Figure 1:
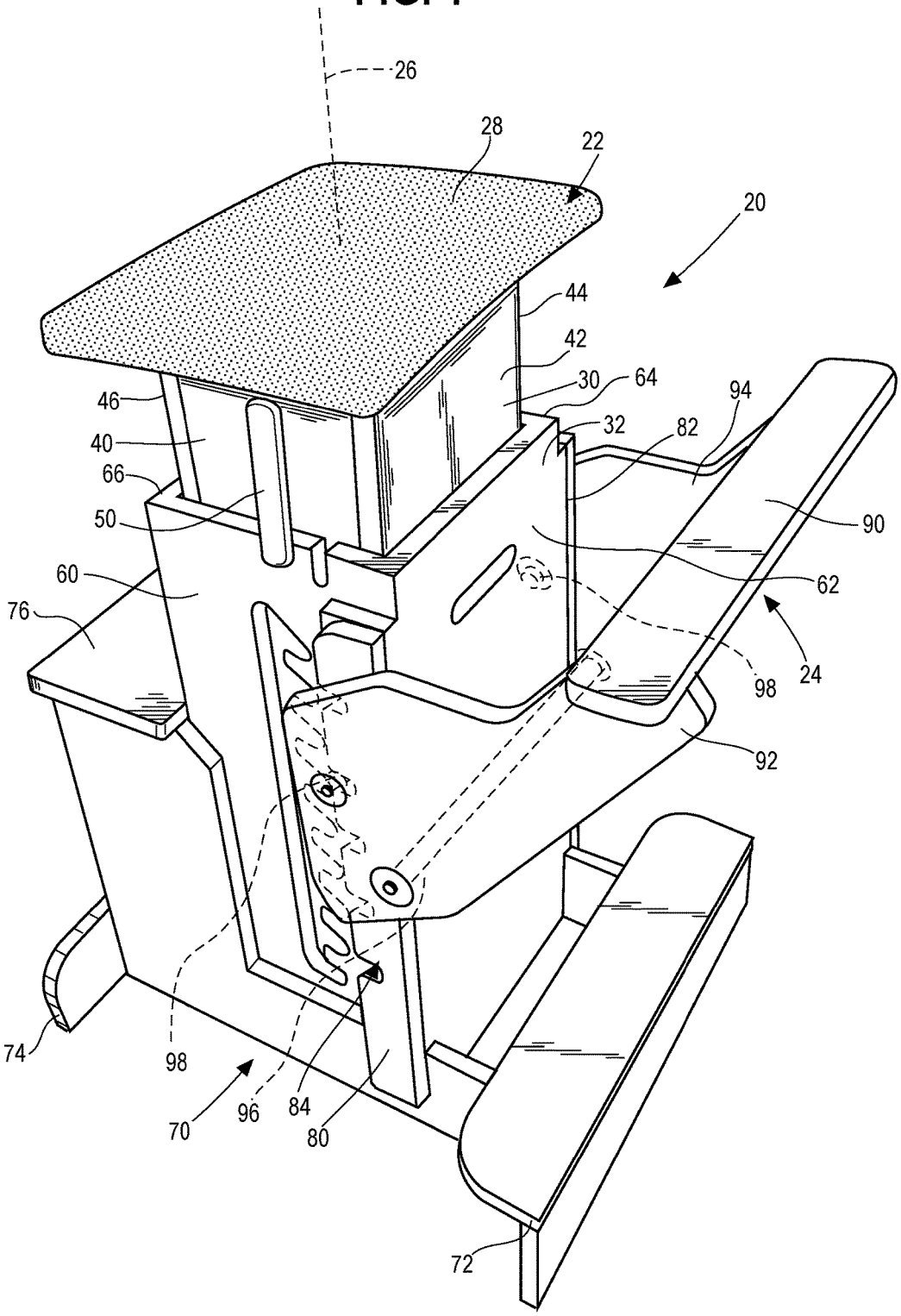
FIG. 1 is a top perspective view of a telescope observation chair assembly including an adjustable seat in a partially raised configuration and an adjustable footrest in an open and partially raised configuration.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments disclosed herein and variations readily apparent to those of ordinary skill in the art. Various modifications to the illustrated embodiments will be readily apparent to those skilled in the art, and the generic principles herein can be applied to other embodiments and applications without departing from embodiments of the invention. Thus, the disclosed embodiments are not intended to be limited to embodiments shown, but are to be accorded the widest scope consistent with the principles and features disclosed herein. The following detailed description is to be read with reference to the figures, in which like elements in different figures have like reference numerals.

Figure 2:
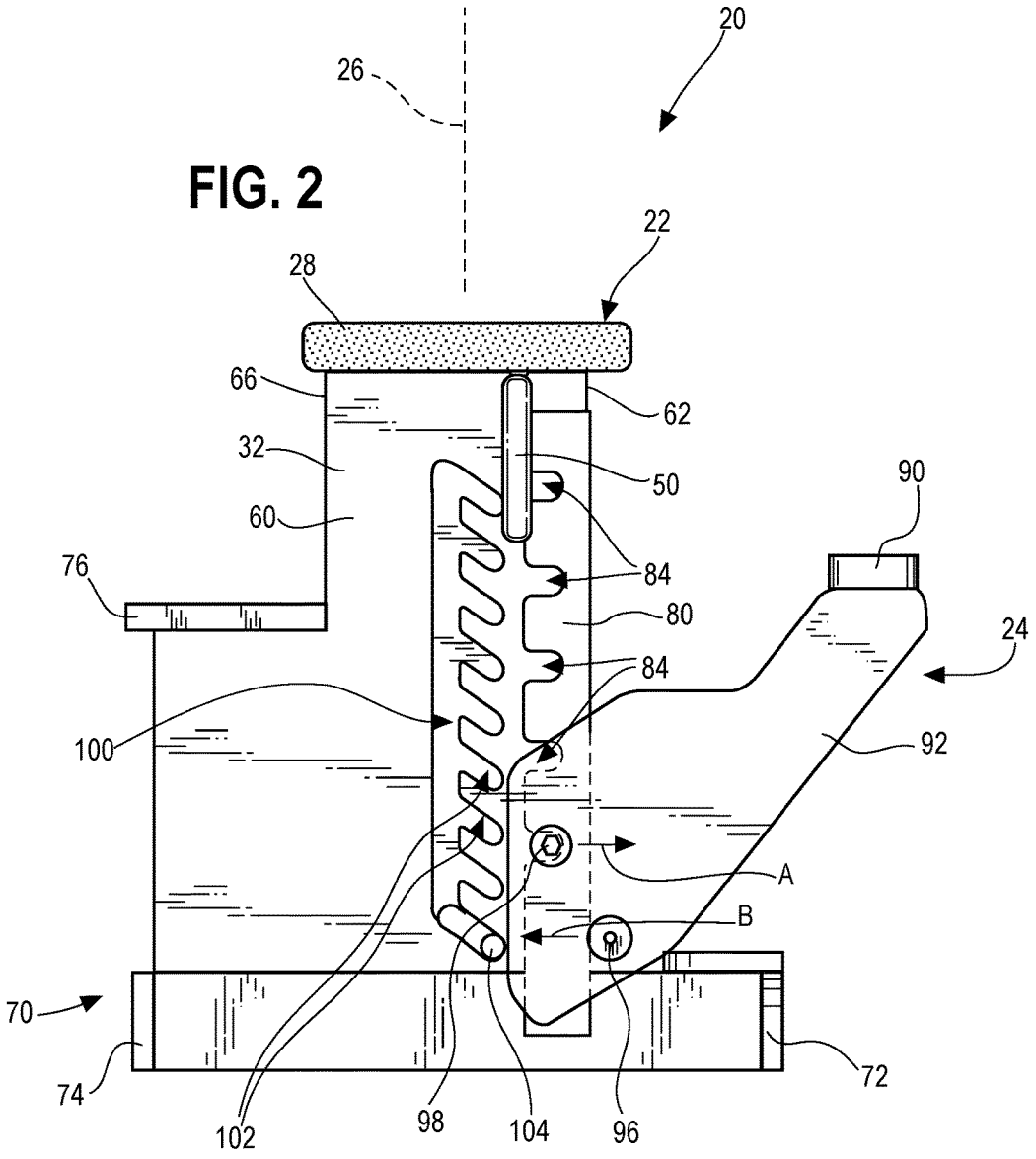
FIG. 2 is a side elevational view of the assembly of FIG. 1 with the adjustable seat in a completely lowered configuration and the adjustable footrest in an open and completely lowered configuration.

The figures, which are not necessarily to scale, depict selected embodiments and are not intended to limit the scope of any embodiments of the invention. Skilled artisans will recognize the examples provided herein have many useful alternatives and fall within the scope of one or more embodiments of the invention. Further, relative terms such as "above," "below," "upward," "downward," "clockwise," and "counterclockwise," refer to the assembly as shown in FIG. 2. Therefore, when these terms are used, reference is made to the configuration as shown in this figure.

Turning to the figures, the following description and drawing figures pertain to embodiments of a telescope observation chair assembly including an adjustable seat and footrest. While the embodiments disclosed herein include both an adjustable seat and footrest, it is contemplated that the chair assembly may include only the adjustable seat or only the adjustable footrest. While embodiments of the assembly can be constructed using a material such as wood, other materials are contemplated. For example, portions of the assembly may be constructed with one or more polymers, one or more metals, one or more composites, or some other material.

Referring to FIG. 1, a perspective view of a telescope observation assembly 20 is shown. The assembly 20 includes an adjustable seat 22 and an adjustable footrest 24. The seat 22 is adjustable vertically along a longitudinal axis 26. The footrest 24 is also adjustable along an axis parallel to the axis 26. The seat 22 includes a pad 28 on which a user of the assembly 20 may sit, and a telescoping portion 30 that extends downward from the pad 28 into a housing 32. The pad 28 may be a cushion, an upholstered pad, or some other generally flat or rounded surface for receiving a sitting user. The telescoping portion 30 includes a first leg or wall 40, a second leg or wall 42, a third leg or wall 44, and a fourth leg or wall 46. In some embodiments, the legs 40, 42, 44, 46 are flat planks joined together and disposed at 90 degree angles with respect to one another. The seat 22 also includes a handle 50 that is rotatable by a user to adjust the height of the seat 22, as will be discussed in greater detail hereinafter below. In other embodiments, the telescoping portion 30 may include any suitable number of legs.

Still referring to FIG. 1, the handle 50 is coupled with an adjustment rod 52 (shown in FIG. 8), that is interior to the telescoping portion 30 of the seat 22. The handle 50 is operable to adjust the seat 22 by rotating the adjustment rod 52, as will be described in greater detail hereinafter below. The telescoping portion 30 of the seat 22 is telescopically received by the housing 32 such that the telescoping portion 30 moves up and down within the housing 32. The housing 32 includes a first wall 60, a second wall 62, a third wall 64, and a fourth wall 66, which telescopically receive, and are positioned adjacent the first leg 40, the second leg 42, the third leg 44, and the fourth leg 46 of the telescoping portion 30 of the seat 22, respectively.

Each of the housing 32 and the telescoping portion 30 have a generally rectangular or square cross section. However, the cross section one or both of the housing 32 and the telescoping portion 30 may have the shape of a circle, a square, a triangle, a trapezoid, a pentagon, a hexagon, or any other polygonal shape. As seen in FIG. 1, the housing 32 also includes a base portion 70, which includes a first foot 72 and a second foot 74. The base portion 70 also includes a step or ledge 76 that can be used by a user to step upon to access the pad 28 of the seat 22 during an "in-use" configuration of the assembly 20. The first foot 72 and the second foot 74 are used to stabilize the assembly 20 when in use, and may be made larger or smaller, depending on the size of the assembly 20.

Still referring to FIG. 1, the housing 32 further includes a first support plank 80 and a second support plank 82 that are coupled with or are integral with an outer face of the first wall 60 and an outer face of the third wall 64, respectively. Each of the first support plank 80 and the second support plank 82 includes a plurality of semicircular notches 84 cut therefrom, which are generally evenly spaced apart along axes parallel with the longitudinal axis 26. The first and second support planks 80, 82 may include between two and fifteen notches 84, or between four and ten notches 84, or five notches 84. The first and second support planks 80, 82 may be integral with the housing 32, or may be separate elements that are coupled with the housing 32 via one or more coupling mechanisms, such as glue, screws, rivets, nails, or some other coupling mechanism.

Referring again to FIG. 1, the footrest 24 includes an arm 90 that is connected to both a first leg 92 and a second leg 94. The first leg 92 and the second leg 94 are coupled to a first stabilizing rod 96 and one or more stabilizing pins 98. The one or more stabilizing pins 98 may be included on one or more of the first leg 92 and the second leg 94. As will be described in greater detail hereinafter below, the first rod 96 and the stabilizing pins 98 act to keep the footrest 24 in place based on a desired height of the footrest 24. The first stabilizing rod 96 and the stabilizing pins 98 may be coupled to the first and second legs 92, 94 with one or more of the abovementioned coupling mechanisms. In one embodiment, the rod 96 and pins 98 are connected to the legs 92, 94 with bolts, washers, and nuts tightened along the bolts.

Referring to FIG. 2, longitudinal slots 100 having a plurality of downwardly extending parallel grooves 102 are formed or cut out from within the first wall 60 and the third wall 64 of the housing 32, the third wall 64 being a mirror image of the first wall 60. As will be described in greater detail below, the longitudinal slots 100 and the grooves 102 retain and allow for the maneuvering of a locking rod 104 that can be engaged and disengaged from any of the plurality of grooves 102, slid up and down along the slots 100, and re-engaged within another of the plurality of grooves 102. In some embodiments, covers (not shown) are placed over the slots 100 and grooves 102 to hide the slots 100 and grooves 102 from outside access by a user.

Still referring to FIG. 2, the notches 84 along the first and second support planks 80, 82 are operable to receive the stabilizing pins 98 to keep the footrest 24 in place during use of the assembly 20. When the footrest 24 is in an "in-use" configuration, as shown in FIG. 2, the stabilizing pins 98 induces a force in the direction of arrow A. An equal and opposite force is induced by the first stabilizing rod 96 in the direction of arrow B on the second wall 62 of the housing. These equal and opposite forces help to keep the footrest 24 in place during use of the footrest 24.

Figure 3:
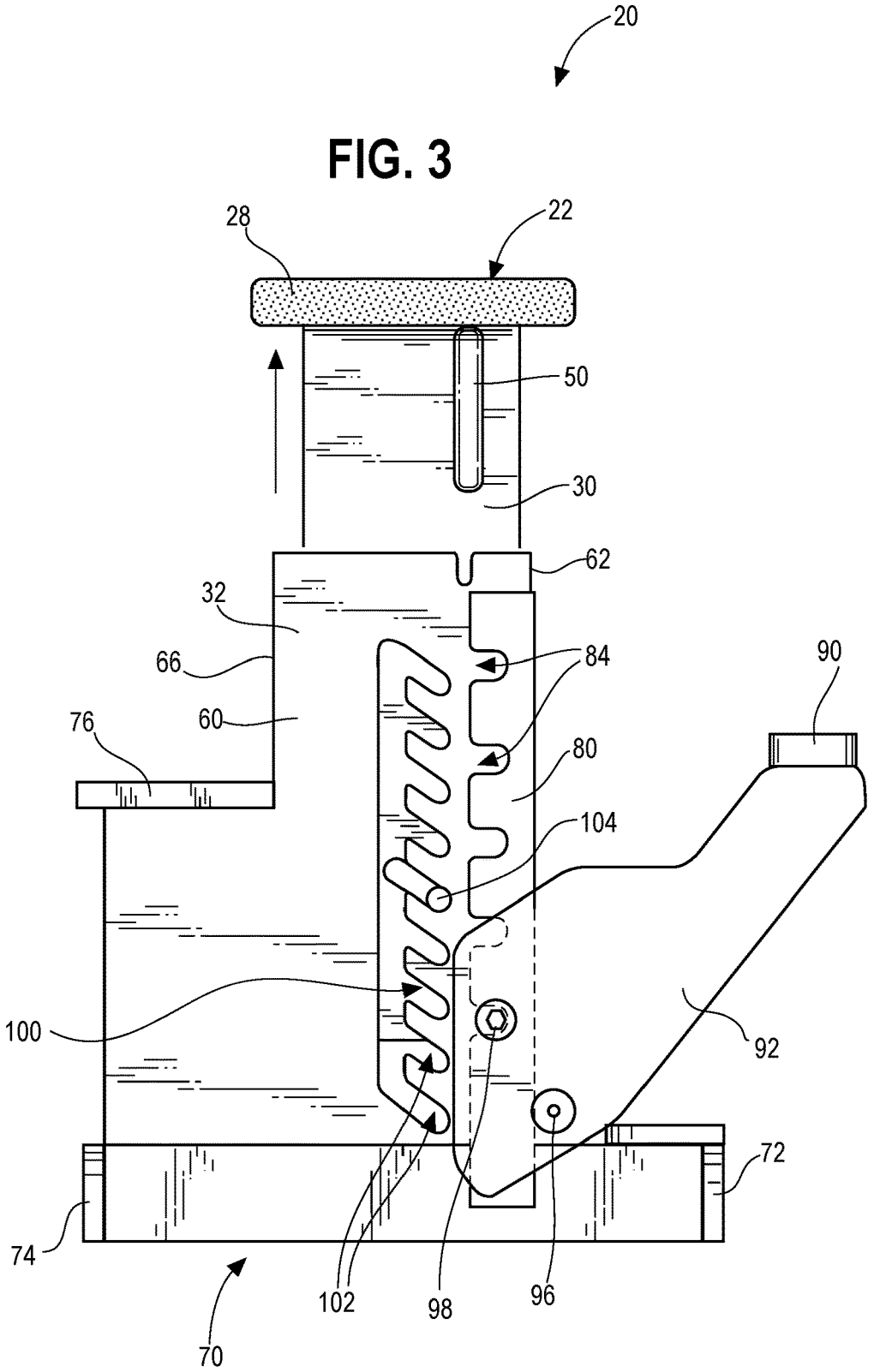
FIG. 3 is a side elevational view of the assembly of FIG. 1 with the adjustable seat in an adjusting configuration and the footrest in an open and lowered configuration.
Figure 4:
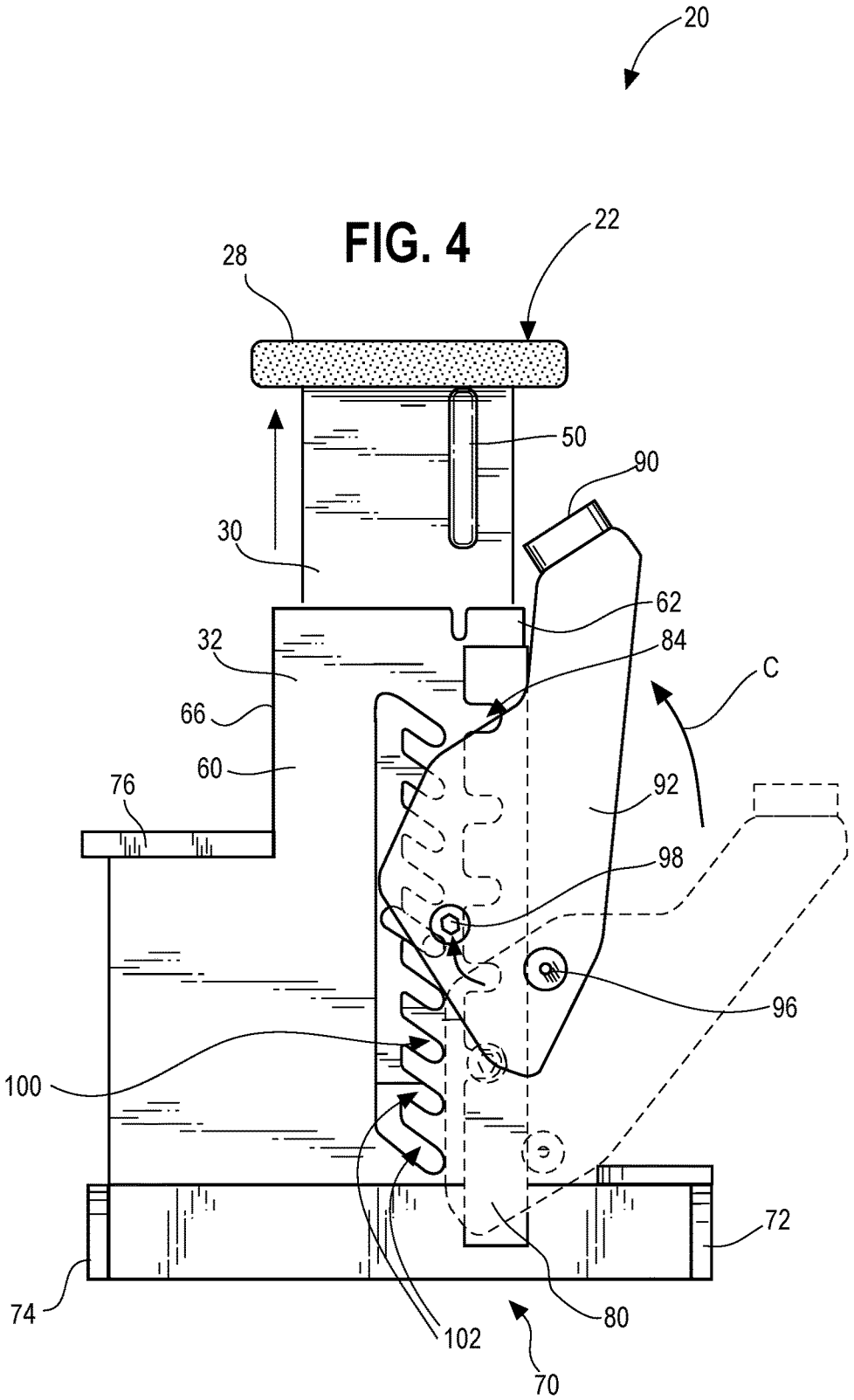
FIG. 4 is a side elevational view of the assembly of FIG. 1 with the adjustable seat in an adjusting configuration and the footrest in a closed configuration.
Figure 5:
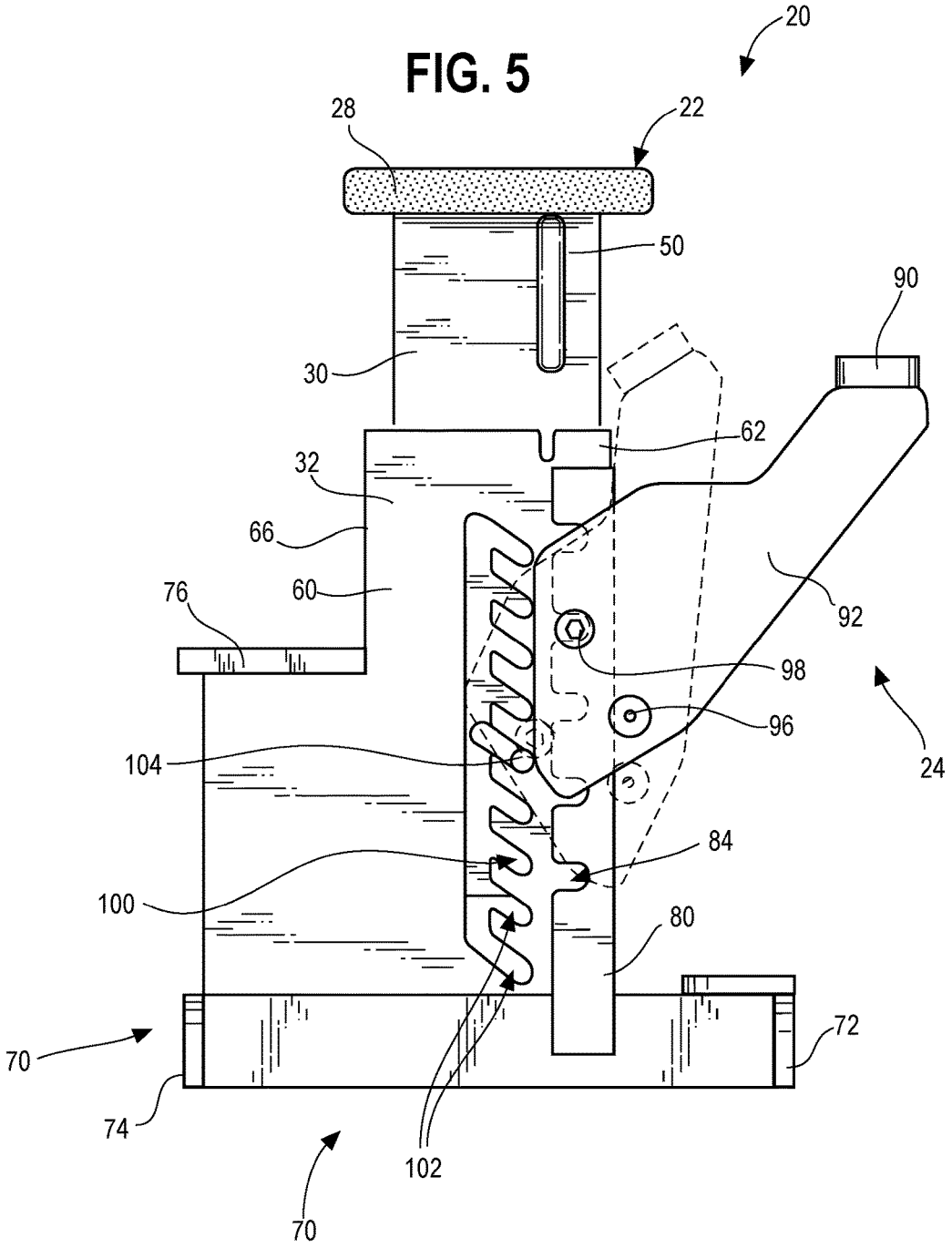
FIG. 5 is a side elevational view of the assembly of FIG. 1 with the adjustable seat in an adjusting configuration and the footrest in an open and raised configuration.

Referring to FIG. 3, the footrest 24 is shown in a static configuration. Referring to FIG. 4, the footrest 24 is shown in an adjusting configuration. To disengage the footrest 24 for adjustment purposes, a user lifts and twists the arm 90 of the footrest 24 upward and inward in the direction of arrow C. After lifting the arm 90, the user can disengage the stabilizing pins 98 from one of the plurality of notches 84. The user can then translate the footrest 24 up or down along an axis parallel with the axis 26, and can reengage the stabilizing pins 98 into another of the plurality of notches 84, as shown in FIG. 5. In some embodiments, the footrest 24 may be positioned such that it is folded vertically and the footrest 24 is collapsed as shown in FIG. 4.

Figure 6:
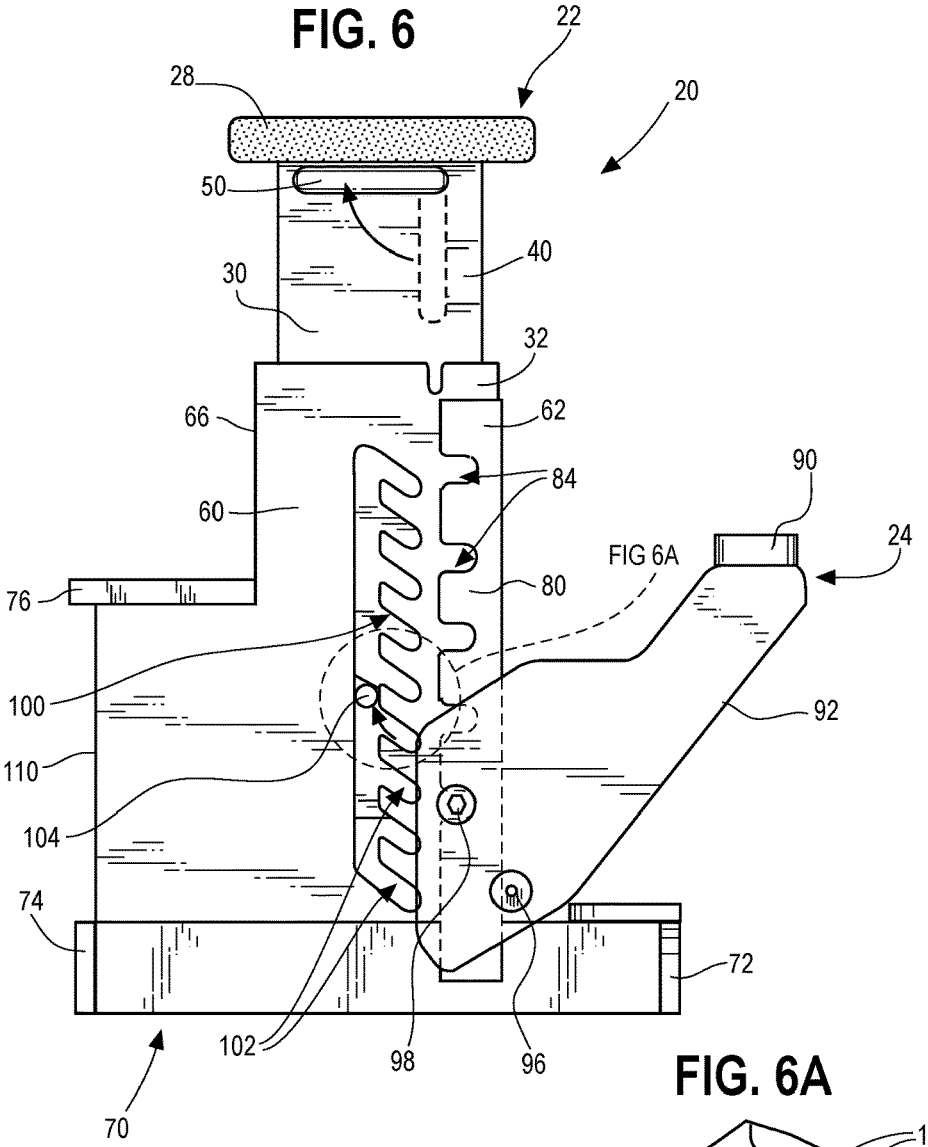
FIG. 6 is another side elevational view of the assembly of FIG. 1 with the adjustable seat in a partially raised configuration and the adjustable footrest in an open and completely lowered configuration. A handle or adjustment mechanism for adjusting the seat is in an adjusting position.
Figure 7:
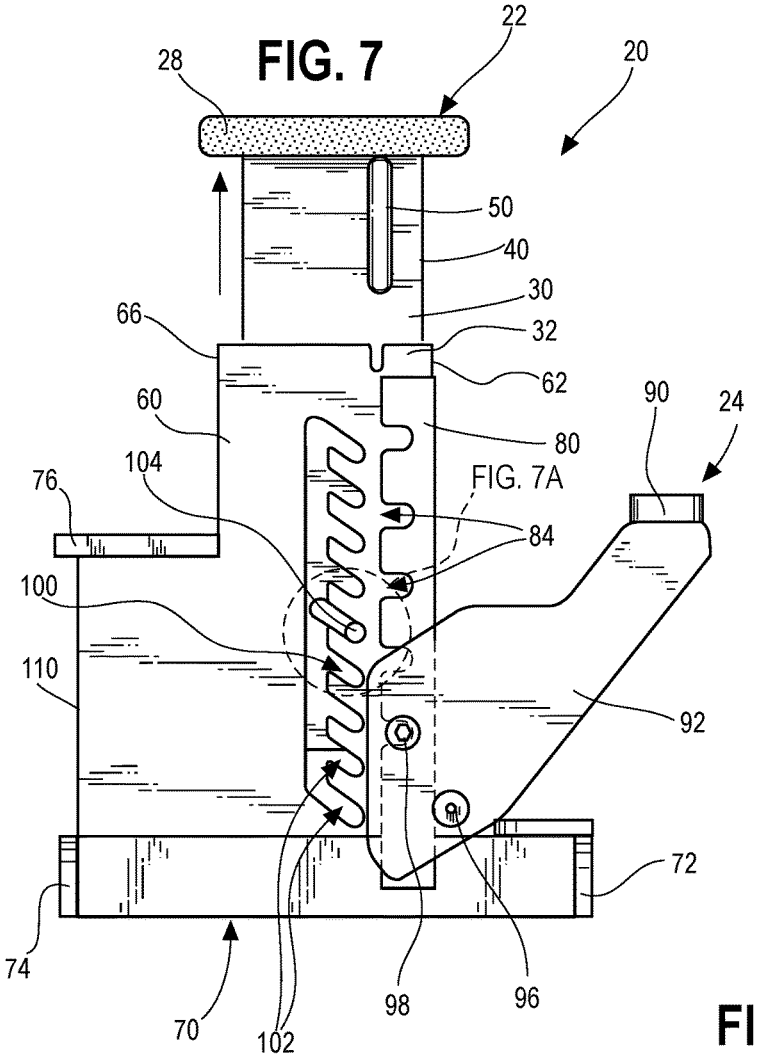
FIG. 7 is another side view of the assembly of FIG. 1 with the adjustable seat in a partially raised configuration and the adjustable footrest in an open and completely lowered configuration. The handle or adjustment mechanism is in a static configuration.

Now referring to FIGS. 6 and 7, additional side views of the assembly 20 are shown. Referring to FIG. 6, the handle 50 is shown offset 90 degrees clockwise. This configuration allows the seat 22 to be translated vertically along the axis 26, as will be described below. The handle 50 may be constructed from steel and/or wood. In some forms, a steel piece is welded to a locking collar with a screw to carry the load of an adjustment assembly (discussed below) when the handle 50 is pulled upward, as shown in FIG. 6 to release the adjustment assembly.

Still referring to FIGS. 6 and 7, the first wall 60 is shown in detail. In some embodiments, the first wall 60 and the third wall 64 are mirror images of one another. The first wall 60 and the third wall 64 may be generally L-shaped or reverse L-shaped. In other embodiments, the first wall 60 and the third wall 64 may have alternative shapes or configurations. In some embodiments, the ledge 76 is connected to both the first wall 60 and the third wall 64 with one or more of the coupling mechanisms as described above. A fifth wall 110 of the housing 32 is disposed between the second foot 74 and the ledge 76 and between the first wall 60 and the third wall 64 (and parallel to the fourth wall 66). The fourth wall 66 and the fifth wall 110 are thus separated by the ledge 76.

Figure 6A:
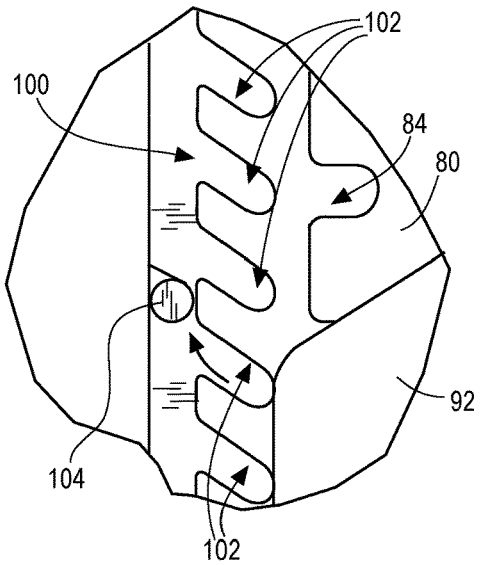
FIG. 6A is a partial view of the adjustment mechanism shown in FIG. 6 shown in the adjusting position.
Figure 7A:
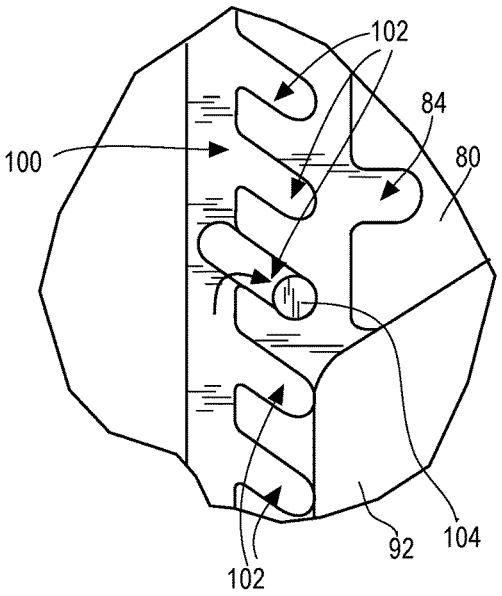
FIG. 7A is a partial view of the adjustment mechanism of FIG. 7 shown in the static configuration.

Referring now to FIGS. 6A and 7A, enlarged portions of the slot 100 and notches 84 are shown. Referring to FIG. 6A, the locking rod 104 is shown in a retracted position, such that the locking rod 104 is pulled upward out of one of the plurality of notches 84 by a user such that the locking rod 104 is disposed within the longitudinal slot 100. When the locking rod 104 is in such a configuration, the user can manually lift the seat 22 up or down, to alter the adjustment of the seat 22. Referring to FIG. 7A, the locking rod 104 is shown re-engaged with another of the plurality of 102. In the configuration shown in FIG. 7, the seat 22 is in a static configuration, thus, the user has reengaged the locking rod 104 into one of the plurality of grooves 102 because the user has reached a desired height of the seat 22.

Figure 8:
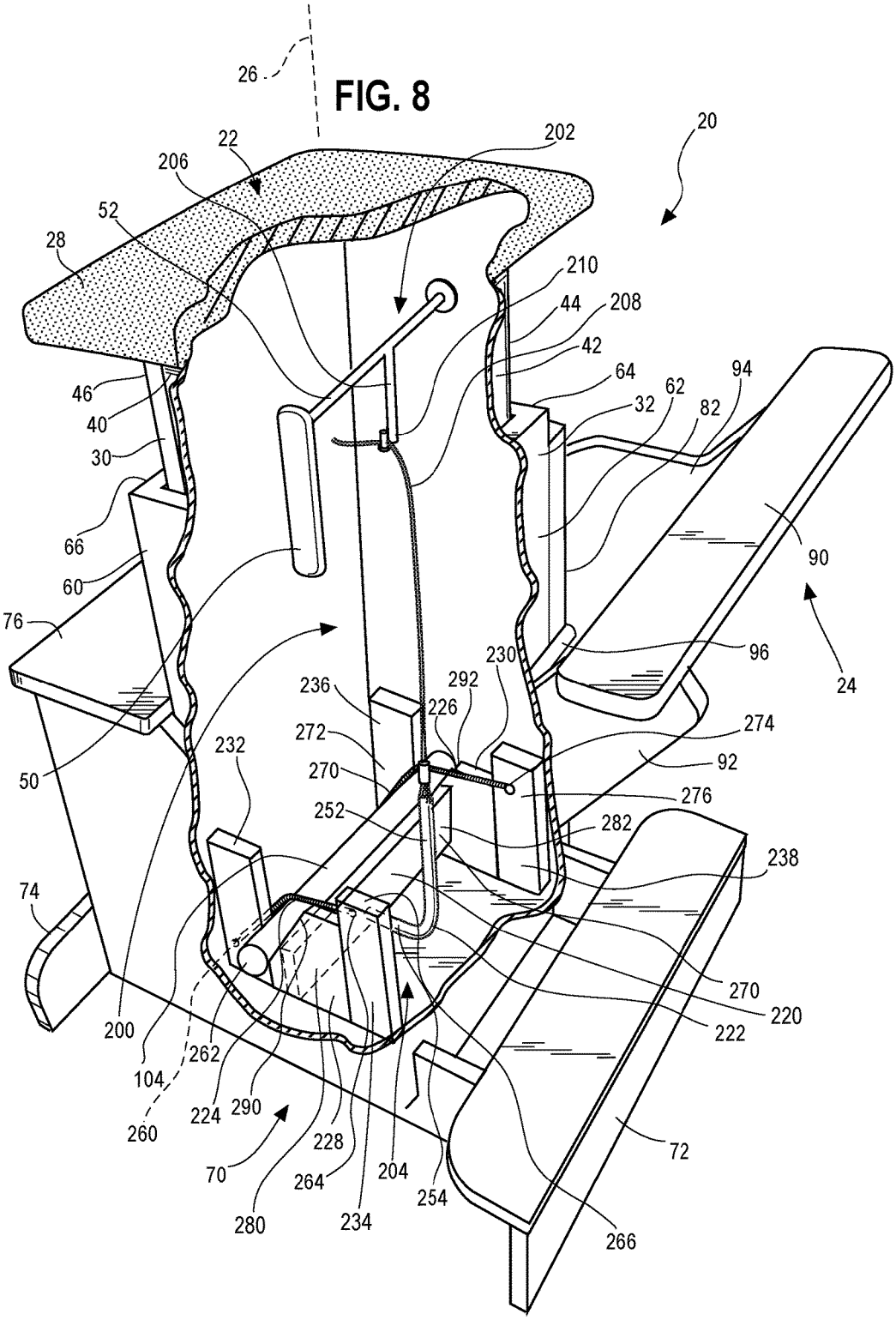
FIG. 8 is a top perspective view of the assembly of FIG. 1 with portions thereof removed to show internal components of an adjustment assembly interior to a telescoping portion of the assembly. The adjustment assembly is in a static configuration.
Figure 9:
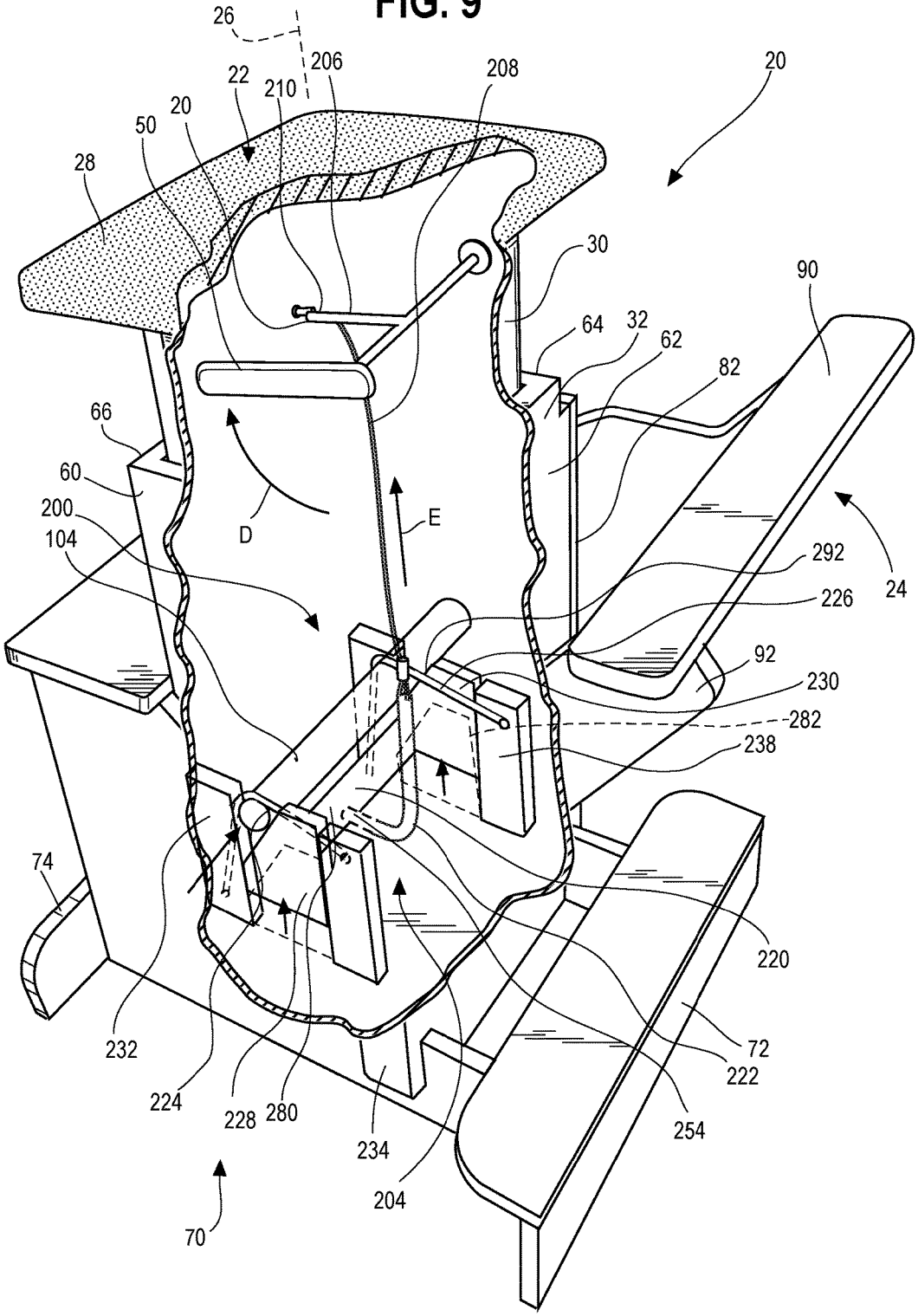
FIG. 9 is a top perspective view similar to that of FIG. 8 and showing the adjustment assembly in an adjusting configuration.

Referring now to FIGS. 8 and 9, an adjustment assembly 200 is shown in detail. The adjustment assembly 200 includes an upper assembly 202 and a lower assembly 204. The upper assembly 202 includes the handle 50, the adjustment rod 52, a cable rod 206 that extends perpendicularly from the adjustment rod 52, and a cable 208 connected to a first end 210 of the cable rod 206. The lower assembly 204 includes a locking bar 220, the locking rod 104, an L-rod 222, a first spring 224, a second spring 226, a first lock slide 228, a second lock slide 230, a first stationary plank 232, a second stationary plank 234, a third stationary plank 236, and a fourth stationary plank 238. The four stationary planks 232, 234, 236, 238 hold components comprising the lower adjustment assembly 204 in place. The first stationary plank 232 and the second stationary plank 234 are secured to an inner surface of the first leg 40 of the telescoping portion 30, while the third stationary plank 236 and the fourth stationary plank 238 are secured to an inner surface of the third leg 44 of the telescoping portion 30.

Still referring to FIG. 8, when the adjustment assembly 200 is in a "static configuration," both the handle 50 and the cable rod 206 are disposed in a parallel configuration, and are parallel with the longitudinal axis 26. The cable 208 connects the first end 210 of the cable rod 206 and a first end 252 of the L-rod 222. A second end 254 of the L-rod 222 is coupled with the locking bar 220. The second end 254 of the L-rod 222 may be coupled with the locking bar 220 via an adhesive, a set screw, or via any other coupling mechanism. In some embodiments, the cable 208 is attached directly to the locking bar 220, or is connected via a component different than the L-rod 222.

The locking rod 104 is disposed adjacent and above the locking bar 220. The locking rod 104 is secured in place by a downward force applied by the first spring 224 and the second spring 226. As will be described in greater detail below, the locking rod 104 may move vertically, horizontally, or diagonally along diagonal sides of the first and second lock slides 228, 230. A first end 260 of the first spring 224 is secured to a lower end 262 of the first stationary plank 232 and a second end 264 of the first spring 224 is secured to an upper end 266 of the second stationary plank 234. A first end 270 of the second spring 226 is secured to a bottom end 272 of the third stationary plank 236, and a second end 274 of the second spring 226 is secured to an upper end 276 of the fourth stationary plank 238. The springs 224, 226 place a downward force upon the locking rod 104 to maintain it in place unless an upward force caused by displacement of the locking bar 220 via the cable 208 forces the springs 224, 226 upward.

Still referring to FIG. 8, the first lock slide 228 is fixedly coupled with a first end 280 of the locking bar 220 and the second lock slide 230 is fixedly coupled with a second end 282 of the locking bar 220. Therefore, when the locking bar 220 is displaced vertically, the slides 228, 230 are also displaced vertically. The first lock slide 228 is trapezoidal in shape, and includes an angled surface 290. The second lock slide 230 is also trapezoidal in shape, and includes an angled surface 292. The locking rod 104 rests upon the angled surfaces 290, 292 when in the stationary state.

The first lock slide 228 is disposed between the first stationary plank 232 and the second stationary plank 234 and the second lock slide 230 is disposed between the third stationary plank 236 and the fourth stationary plank 238. The slides 228, 230 are not fixedly coupled to any of the planks 232, 234, 236, 238. Rather, the slides 228, 230 are snugly accommodated therebetween, and are capable of moving vertically along the sides of the planks 232, 234, 236, 238 when the locking bar 220 is displaced vertically, i.e., when the handle 50 is turned by a user. The first spring 224 and the second spring 226 keep the locking rod 104 and the locking bar 220 held in place when the adjustment assembly 200 is in the static configuration.

Now referring to FIG. 9, when the handle 50 is turned 90 degrees clockwise, as shown in the figure, the cable rod 206 moves with the cable rod 206, and thus gets pulled. The configuration shown is referred to as the adjusting configuration of the adjustment assembly 200. After the handle 50 has been rotated in the direction of arrow D, the cable 208 is pulled upward in the direction of arrow E, which in turn pulls up on the L-rod 222. Since the L-rod 222 is connected with the locking bar 220, the locking bar 220 is also pulled upward. The locking rod 104 moves from its position within the grooves 102 into the slots 100, and can be moved vertically therealong. The springs 224, 226 maintain a downward force on the locking rod 104, thus, the locking rod 104 is biased along the angled surfaces 290, 292 of the slides 228, 230 and is biased diagonally, along a path of one of the plurality of grooves 102.

As a result, and referring to FIGS. 6A and 7A, as the slides 228, 230 are pulled upward, the locking rod 104 moves out from two of the grooves 102 of the housing 32, each of the grooves 102 disposed on either side of the housing 32. As will be appreciated by one of ordinary skill in the art, the adjustment assembly 200 may be configured such that the handle 50 need not be rotated 90 degrees. Rather, the handle 50 may be rotated between about 5 degrees and about 180 degrees, or between about 45 degrees and about 135 degrees, or between about 60 and about 90 degrees to adjust the seat 22.

Figure 10:
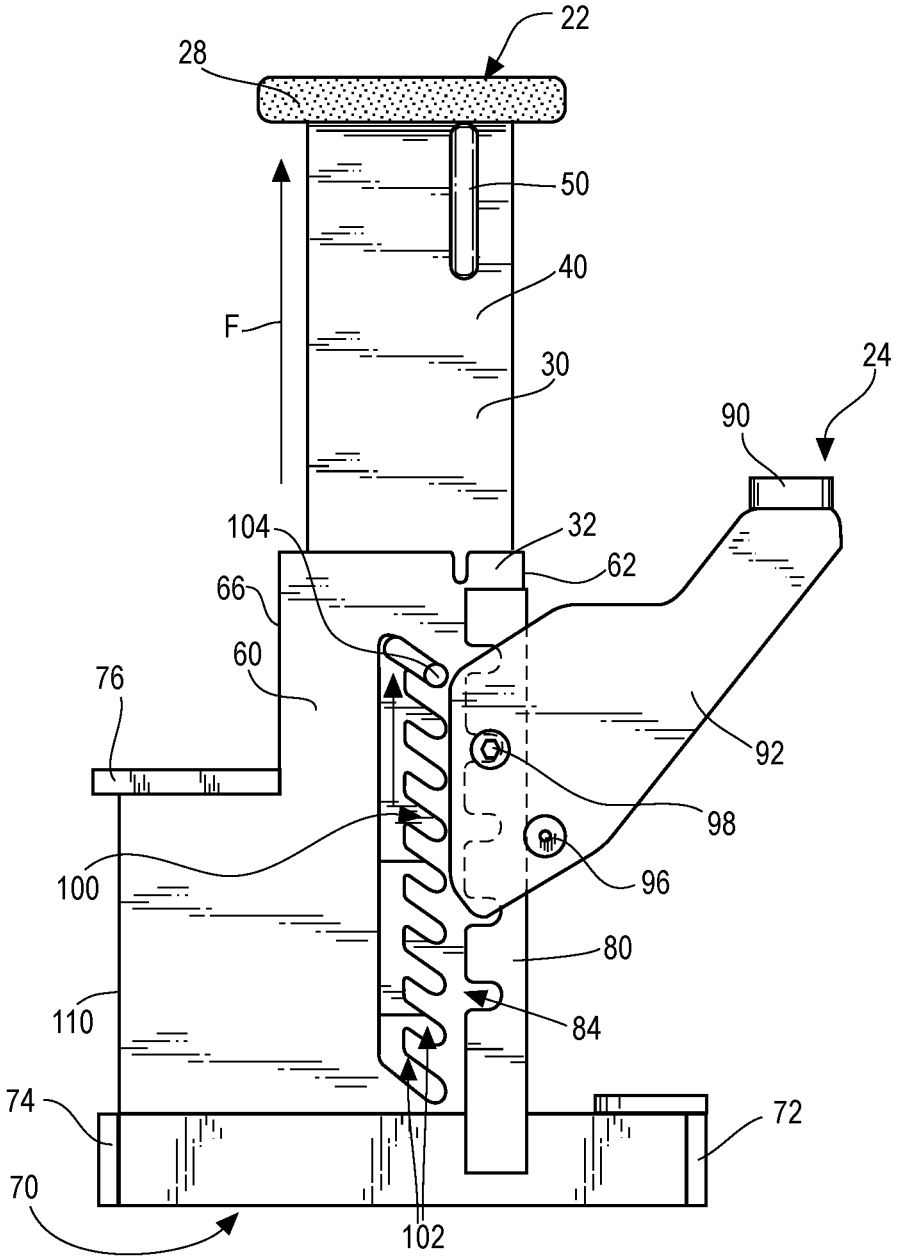
FIG. 10 is a side elevational view of the assembly of FIG. 1 with the adjustable seat in a fully raised configuration and the adjustable footrest in a fully raised configuration.

Referring again to FIGS. 8 and 9, to adjust the height of the assembly 20, a user turns the handle 90 degrees counterclockwise and pulls the seat upward in the direction of arrow F (FIG. 10). Thus, when the locking rod 104 is disengaged, the user can manually move the pad. 28 up or down, as seen in FIG. 6. When the assembly 20 is at a desired location, the user can release the seat 22, thereby allowing the locking rod 104 to move into another one of the plurality of grooves 102. In this manner, the springs 224, 226 apply a downward force along the locking rod 104, which forces the locking rod 104 along the path of the grooves 102.

It will be appreciated by one of ordinary skill in the art that once a user releases the handle 50, the slides 228, 230 are lowered, yet the springs 224, 226 continue to bias the locking rod 104 against the angled surfaces 290, 292 of the slides 228, 230. Because of the nature of the angled surfaces 290, 292 of the slides 228, 230, and referring to FIGS. 6A and 7A, once the handle 50 is released by the user, the locking rod 104 will move in a downward, and left to right direction. Thus, because of the forces applied by the spring 224, 226, the locking rod 104 is forced into the grooves 102 when the assembly 200 moves from the adjusting configuration to the static configuration.

Referring again to FIGS. 3-5, the footrest 24 is adjusted by disengaging the first stabilizing rod 96 from one of the plurality of notches 84 by manually lifting the arm 90 of the footrest 24, as shown in FIG. 4, rotating the footrest 24 counterclockwise, and manually lifting the footrest 24 along the longitudinal axis 26 until the footrest is at the desired height. When at the desired height, the user rotates the footrest 24 clockwise to reengage the stabilizing pins 98 into one of the plurality of notches 84. The first stabilizing rod 96 engages with the second wall 62 of the housing.

As described in detail above, the present invention provides for both a seat 22 and a footrest 24 that are independently adjustable. This allows a user to more easily configure the assembly 20 for their own use. In some embodiments, only the seat 22 is included, without the footrest 24.

The foregoing description was primarily directed to embodiments of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not be limited by the above disclosure.

What is claimed is:

1. A telescope observation chair assembly, comprising:
- a seat including:
  - a pad,
  - a telescoping portion extending from the pad, and
  - an adjustment assembly at least partially disposed interior to the telescoping portion;
- a housing surrounding at least at portion of the seat and comprising:
  - one or more walls having one or more slots and one or more grooves cutout therefrom, the one or more walls receiving the telescoping portion of the seat,
  - one or more support planks, the one or more support planks having a plurality of notches, and
  - one or more feet extending from a base portion of the housing; and
- a footrest comprising:
  - an arm,
  - a first leg connected with the arm,
  - a second leg connected with the arm,
  - a first stabilizing rod, and
  - one or more stabilizing pins,
- wherein the first stabilizing rod connects the first leg to the second leg, and the one or more stabilizing pins are provided on at least one of the first leg and the second leg; and
- wherein the one or more stabilizing pins are received by the one or more notches of the one or more support planks.

2. The assembly of claim 1, wherein the one or more support planks includes a first support plank and a second support plank.

3. The assembly of claim 2, wherein the plurality of notches are semicircular cutouts.

4. The assembly of claim 2, wherein the first support plank and the second support plank are parallel with a longitudinal axis of the seat.

5. The assembly of claim 1, wherein the one or more walls comprises a first wall, a second wall, a third wall, and a fourth wall.

6. The assembly of claim 5, wherein the one or more notches and the one or more slots are cut out of the first wall and the third wall.

7. The assembly of claim 6, wherein the one or more walls define a rectangular cross section.

8. The assembly of claim 1, wherein the adjustment assembly includes an upper adjustment assembly and a lower adjustment assembly,
- the upper adjustment assembly comprising:
  - a handle,
  - an adjustment rod coupled with the handle, and
  - a cable coupled with the adjustment rod; and
- the lower adjustment assembly comprising:
  - a locking bar;
  - a locking rod disposed adjacent the locking bar;
  - a first slide coupled with the locking bar; and
  - a second slide coupled with the locking bar.

9. The assembly of claim 8, wherein the lower adjustment assembly further includes:
- a first stationary plank,
- a second stationary plank,
- a third stationary plank, and
- a fourth stationary plank;
- wherein each of the stationary planks is coupled with an interior side of the one or more walls of the housing.

10. The assembly of claim 9 further comprising a first spring coupled with the first stationary plank and the third stationary plank, and a second spring coupled with the second stationary plank and the fourth stationary plank.

11. The assembly of claim 10, wherein each of the first spring and the second spring maintain the locking rod in place within one of the plurality of notches during an "in use" configuration of the assembly.

12. The assembly of claim 1, wherein the housing comprises wood.

13. The assembly of claim 1, wherein the plurality of grooves includes at least 9 grooves, and the plurality of notches includes at least 5 notches.

14. The assembly of claim 1, wherein the housing further includes a ledge that is adjacent the one or more walls.

15. The assembly of claim 1, wherein the footrest is capable of being rotated into a non-use configuration and an in-use configuration.

16. A method of operating a telescope observation chair assembly, comprising:
- rotating a handle from a first position to a second position to release a locking rod from a first notch of a plurality of notches, the locking rod disposed within a telescoping portion of a seat;
- translating the seat vertically;
- rotating the rod to the first position to engage the locking rod with a second notch of the plurality of notches;
- rotating a footrest from a first configuration to a second configuration, the footrest having an arm, a first leg connected with the arm, a second leg connected with the arm, a first stabilizing rod, and a one or more stabilizing pins,
- wherein the first stabilizing rod connects the first leg to the second leg, and the one or more stabilizing pins are connected to one or more of the first leg and the second leg; and
- wherein the one or more stabilizing pins are received by the one or more notches of one or more support planks coupled with a housing of the chair assembly.

17. The method of claim 16, wherein the housing includes a first wall, a second wall, a third wall, and a fourth wall, the walls telescopically receiving the telescoping portion of the seat.

18. The method of claim 17, wherein the seat includes a first leg, a second leg, a third leg, and a fourth leg.

19. The method of claim 18, rotating the handle from the first position to the second position raises a cable that is coupled with a locking rod, the locking rod moving from within the first notch to a longitudinal slot.

20. The method of claim 19, wherein the seat includes an upholstered pat at an upper end thereof.

* * * * *